US009291092B2

(12) United States Patent
Sumser et al.

(10) Patent No.: US 9,291,092 B2
(45) Date of Patent: Mar. 22, 2016

(54) TURBINE FOR AN EXHAUST GAS TURBOCHARGER

(71) Applicant: DAIMLER AG, Stuttgart (DE)

(72) Inventors: Siegfried Sumser, Stuttgart (DE); Torsten Hirth, Rutesheim (DE); Slefgried Weber, Stuttgart (DE)

(73) Assignee: DAIMLER AG, Stuttgart (DE)

( * ) Notice: Subject to any disclaimer, the term of this patent is extended or adjusted under 35 U.S.C. 154(b) by 307 days.

(21) Appl. No.: 13/907,934

(22) Filed: Jun. 2, 2013

(65) Prior Publication Data

US 2013/0327038 A1 Dec. 12, 2013

Related U.S. Application Data

(63) Continuation-in-part of application No. PCT/EP2011/005662, filed on Nov. 11, 2011.

(30) Foreign Application Priority Data

Dec. 9, 2010 (DE) ..... 10 2010 053 951

(51) Int. Cl.
*F02D 23/00* (2006.01)
*F01D 17/14* (2006.01)
(Continued)

(52) U.S. Cl.
CPC ..... *F02B 37/00* (2013.01); *F01D 17/105* (2013.01); *F01D 17/141* (2013.01); *F01D 17/167* (2013.01); *F05D 2220/40* (2013.01)

(58) Field of Classification Search
CPC ..... F01D 17/141; F01D 17/167; F01D 17/18; F01D 9/02; F09D 9/06; F02B 37/001; F02B 37/004; F02B 37/007; F02B 37/025; F02B 37/22; F01N 13/107; Y02T 10/144; F05D 2250/15; F05D 2250/25
USPC ..... 60/602; 415/159–164
IPC ..... F01D 9/00, 9/02
See application file for complete search history.

(56) References Cited

U.S. PATENT DOCUMENTS 2,861,774 A * 11/1958 Buchi ..... 415/158
3,292,364 A * 12/1966 Cazier ..... 417/380
(Continued)

FOREIGN PATENT DOCUMENTS

DE 2539711 A1 * 3/1977 ..... F01D 9/04
DE 3242713 A1 * 6/1983 ..... F01D 9/06
(Continued)

*Primary Examiner* — Thai Ba Trieu
(74) *Attorney, Agent, or Firm* — Klaus J. Bach

(57) ABSTRACT

In a turbine for an exhaust gas turbocharger of an internal combustion engine having a housing part with accommodation space including a turbine wheel and at least one spiral channel via which exhaust gas of the internal combustion engine may flow. The spiral channel has an outlet cross-section via which the turbine wheel accommodated in the accommodation space may be acted on by the exhaust gas, and has at least one blocking member, which is connected to an adjusting part so as to be movable hereby in the peripheral direction of the accommodation space for adjusting the outlet cross-section ($A_R$, $A_{R\lambda}$, $A_{R,RGR}$). A bypass duct is provided, via which exhaust gas can bypass the turbine wheel and whose flow cross-section is also adjustable by the blocking member moved the adjusting part.

6 Claims, 5 Drawing Sheets

(51) Int. Cl.

| | |
|---|---|
| ***F01D 9/00*** | (2006.01) |
| ***F01D 9/02*** | (2006.01) |
| ***F02B 37/00*** | (2006.01) |
| ***F01D 17/10*** | (2006.01) |
| ***F01D 17/16*** | (2006.01) |

(56) References Cited

U.S. PATENT DOCUMENTS

| | | | | |
|---|---|---|---|---|
| 3,880,549 | A * | 4/1975 | Schrieken | 415/95 |
| 4,141,672 | A * | 2/1979 | Wieland et al. | 415/202 |
| 4,177,005 | A * | 12/1979 | Bozung et al. | 415/204 |
| 4,641,498 | A * | 2/1987 | Markovitch et al. | 415/202 |
| 4,642,025 | A * | 2/1987 | Heiniger et al. | 415/202 |
| 5,215,436 | A * | 6/1993 | Puzyrewski | 415/202 |
| 5,855,117 | A * | 1/1999 | Sumser et al. | 60/602 |
| 6,260,358 | B1 * | 7/2001 | Daudel et al. | 60/602 |
| 7,047,739 | B2 * | 5/2006 | Fledersbacher et al. | 60/602 |
| 8,047,772 | B2 * | 11/2011 | Petitjean et al. | 415/158 |
| 8,191,367 | B2 * | 6/2012 | Lombard et al. | 60/602 |
| 8,209,982 | B2 * | 7/2012 | Sumser et al. | 60/612 |
| 8,621,863 | B2 * | 1/2014 | Kratschrner et al. | 60/602 |
| 8,702,376 | B2 * | 4/2014 | Mokulys et al. | 415/117 |
| 2008/0223039 | A1 * | 9/2008 | Sumser et al. | 60/612 |
| 2011/0067397 | A1 * | 3/2011 | Hirth et al. | 60/602 |
| 2011/0079009 | A1 * | 4/2011 | Kratschrner et al. | 60/605.1 |
| 2011/0097632 | A1 * | 4/2011 | Sumser et al. | 429/408 |
| 2012/0031092 | A1 * | 2/2012 | Sumser et al. | 60/602 |
| 2013/0276444 | A1 * | 10/2013 | Hirth et al. | 60/605.1 |
| 2013/0330178 | A1 * | 12/2013 | Hirth et al. | 415/148 |
| 2014/0000256 | A1 * | 1/2014 | Hirth et al. | 60/605.2 |

FOREIGN PATENT DOCUMENTS

| | | | | |
|---|---|---|---|---|
| DE | 36 06 944 | A1 | 10/1987 | |
| DE | 3617537 | A1 * | 11/1987 | F01D 9/06 |
| DE | 4315474 | C1 * | 9/1994 | F01D 9/06 |
| DE | 19918232 | A1 * | 11/2000 | F02B 37/18 |
| DE | 102008039085 | A1 * | 2/2010 | F02B 37/22 |
| DE | 102008049689 | A1 * | 4/2010 | F04D 29/42 |
| DE | 102009012131 | A1 * | 9/2010 | F02B 37/22 |
| DE | 10 2009 018 769 | A1 | 11/2010 | |
| EP | 1433937 | A1 * | 6/2004 | F02B 37/18 |
| JP | 2004100579 | A * | 4/2004 | F01D 9/06 |
| WO | WO 2004027219 | A1 * | 4/2004 | F01D 17/16 |
| WO | WO 2006102912 | A1 * | 10/2006 | F01D 17/14 |

* cited by examiner

TURBINE FOR AN EXHAUST GAS TURBOCHARGER

This is a Continuation-In-Part application of International patent application PCT/EP2011/005662 filed Nov. 11, 2011 and claiming the priority of German patent application 10 2010 053 951.1 filed Dec. 9, 2010.

BACKGROUND OF THE INVENTION

The invention relates to a turbine for an exhaust gas turbocharger for an internal combustion engine with a turbine housing including a turbine wheel and having a spiral exhaust gas admission channel with an adjustable blocking member.

DE 25 39 711 A1 discloses a spiral casing for turbomachines, in particular in an exhaust gas turbocharger, having an adjustable cross section, at least in parts, at least one tongue being provided which is slidingly guided against the radially inner wall of the spiral casing and displaceable next to this wall in the peripheral direction.

DE 10 2008 039 085 A1 discloses an internal combustion engine for a motor vehicle having an exhaust gas turbocharger which includes a compressor in an intake tract of the internal combustion engine and a turbine in an exhaust tract of the internal combustion engine. The turbine has a turbine housing which includes a spiral channel, coupled to an exhaust gas line of the exhaust tract, and a turbine wheel which is situated within an accommodation space in the turbine housing and which, for driving a compressor wheel of the compressor and is connected to the turbine wheel in a rotationally fixed manner via a shaft, may be acted on by exhaust gas from the internal combustion engine which is guidable through the spiral channel. The turbine includes an adjusting device by means of which a spiral inlet cross section of the spiral channel as well as a nozzle cross section of the spiral channel are jointly adjustable with respect to the accommodation space.

Since exhaust gas turbochargers represent a mass-produced product manufactured in ever-growing quantities in the serial production of internal combustion engines, it is desirable to provide an exhaust gas turbocharger which allows operation of an associated internal combustion engine which is efficient, i.e., low in fuel consumption and low in emissions.

It is therefore the principal object of the present invention to provide a turbine for an exhaust gas turbocharger which has high operational reliability and provides for efficient operation of an internal combustion engine associated with the turbine.

SUMMARY OF THE INVENTION

In a turbine for an exhaust gas turbocharger of an internal combustion engine having a housing part with accommodation space including a turbine wheel and at least one spiral channel via which exhaust gas of the internal combustion engine may flow. The spiral channel has an outlet cross-section via which the turbine wheel accommodated in the accommodation space may be acted on by the exhaust gas, and has at least one blocking member, which is connected to an adjusting part so as to be movable hereby in the peripheral direction of the accommodation space for adjusting the outlet cross-section ($A_R$, $A_{R\lambda}$, $A_{R,RGR}$). A bypass duct is provided, via which exhaust gas can bypass the turbine wheel and whose flow cross-section is also adjustable by the blocking member moved the adjusting part.

This means that for adjusting the flow cross section, the blocking member is moved by moving the adjusting part which is connected thereto. In one position of the adjusting part or in a plurality of positions, the flow cross section of the bypass duct is, for example, at least essentially fluidly blocked so that exhaust gas from the spiral channel is not able to bypass the turbine wheel via the bypass duct.

Beginning at one position of the adjusting part, the adjusting part opens up the flow cross section of the bypass duct at least in parts, so that at least a portion of the exhaust gas flowing through the spiral channel is able to bypass the turbine wheel via the bypass duct without acting on and driving the turbine wheel. The turbine wheel is thus bypassed by at least a portion of the exhaust gas from the spiral channel. This is accompanied by a very high mass flow capacity of the turbine.

The power obtainable from turbines of exhaust gas turbochargers is limited by the maximum mass flow capacity of the turbine. In other words, the mass flow with which the exhaust gas flows through the turbine and is able to drive the turbine or the turbine wheel is limited by the maximum mass flow capacity of the turbine. And so is the engine power output. Since the mass flow capacity of the turbine according to the invention is particularly high due to opening up the bypass duct by means of the adjusting part, the turbine according to the invention may be used even at very high mass flows of the exhaust gas, allowing efficient and effective operation of the internal combustion engine.

Due to the adjustability of the flow cross section, the turbine according to the invention has a very high achievable throughput range, so that it is adaptable to a plurality of different operating points of the internal combustion engine and thus allows operation of the internal combustion engine which is efficient, i.e., low in fuel consumption and low in emissions. In addition, due to the adjustability of the outlet cross section, the turbine according to the invention is adaptable to a plurality of different operating points of the internal combustion engine, so that the turbine is able to operate in many different operating points in an efficiency-optimized manner, which likewise benefits the operation of the internal combustion engine with low fuel consumption and low emissions. The turbine according to the invention has efficiency characteristics that are favorable for the operation of the internal combustion engine with low fuel consumption and low emissions, which, in particular due to the adjustability of the flow cross section of the bypass duct in a particularly large operating range, in particular at least essentially over the entire characteristic map, has a positive effect on the internal combustion engine.

In the turbine according to the invention, the flow cross section of the bypass duct is, for example, at least essentially fluidly blockable by means of the adjusting part. In other words, the cross section is then reduced at least essentially to zero, so that exhaust gas is not able to flow through the bypass duct. In addition, the flow cross section may be opened up with respect to the exhaust gas by means of the adjusting part, so that some exhaust gas can flow through the bypass duct while bypassing the turbine wheel during high-load engine operation.

In one advantageous embodiment of the invention, the flow cross section in one position of the adjusting part is at least essentially fluidly blocked, and in another position of the adjusting part is opened up to the maximum extent. In addition, intermediate positions of the adjusting part are settable in which the flow cross section is smaller than the maximum openable flow cross section and larger than the fluid blocking. The adjusting part is advantageously adjustable between these positions in a continuous and/or stepless manner, so that the flow cross section, and thus the quantity of the exhaust gas flowing through the bypass duct, is efficiently adaptable, as needed, to a plurality of different operating points of the turbine and of the internal combustion engine.

Increasingly stringent emission limits, in particular for nitrogen oxides and particulate emissions, have significantly influenced the supercharging of internal combustion engines by means of an exhaust gas turbocharger. This results in high demands on the charge pressure provided by the exhaust gas turbocharger due to high exhaust gas recirculation (EGR) rates to be achieved in medium to full load ranges of the internal combustion engine. This requires provision of a turbine having small geometric dimensions and size for such an exhaust gas turbocharger. High required turbine power is achieved by increasing the backing-up capacity or by reducing the mass flow capacity of the turbine in cooperation with the internal combustion engine.

In addition, an inlet pressure level of the turbine may be increased by the counter pressure generated by exhaust gas purification device, in particular a particle filter, situated in the flow direction of the exhaust gas, downstream from the turbine, which requires further reduction in the dimensions and size of the turbine. This is accompanied by the problem that such a reduction in the turbine generally means impaired efficiency of the turbine. However, this is necessary in order to meet power requirements of a compressor side of the exhaust gas turbocharger in order to provide a desired air-exhaust gas supply, and thus to provide a desired torque or a desired power, as well as low emissions of the internal combustion engine.

The turbine according to the invention now allows small dimensions and size of the turbine, and thus, provision of a desired back-up behavior, which allows high EGR rates. In other words, a particularly large quantity of exhaust gas may be recirculated from an exhaust gas side of the internal combustion engine to an intake air side thereof, and admixed to the air drawn in by the internal combustion engine, thus keeping the emissions, in particular nitrogen oxides and particulate emissions of the internal combustion engine low.

Furthermore, the described high power requirements on the compressor side of the exhaust gas turbocharger may be met by the turbine, since the turbine allows, for example, a inlet charging operation of its associated internal combustion engine. In addition, the turbine according to the invention has a high mass flow capacity and a high throughput range.

In particular in passenger vehicles, the internal combustion engine, and thus the turbine, has a pronounced non-steady state behavior which is to be influenced by a variable back-up capacity of the turbine, in order to achieve an acceptable driving behavior. This plays an important role in particular in internal combustion engines that are designed according to the so-called downsizing principle. These types of internal combustion engines have a relatively small displacement, but at the same time, high power and high torque, which are achieved by the intense supercharging by means of an exhaust gas turbocharger.

The turbine according to the invention allows variable and adaptable adjustment of the back-up behavior, and thus influencing of the non-steady state behavior, in particular due to the adjustability of the outlet cross section, so that the turbine according to the invention is also usable in internal combustion engines for passenger vehicles as well as in internal combustion engines for utility vehicles, and allows operation of the internal combustion engine which is efficient and thus low in fuel consumption and low in emissions, including low $CO_2$ emissions.

The turbine according to the invention has the further advantages that it has very good efficiency due in particular to the adjustability of the outlet cross section. In addition, this adjustability is achieved by the blocking member using relatively simple means and therefore in an uncomplicated manner as the turbine according to the invention has only a small number of parts, low costs, and a low weight. Furthermore, the turbine according to the invention has only small installation space requirements, which helps solve or avoid packaging problems, in particular in a space-critical area such as an engine compartment. In addition, the turbine according to the invention has high functional reliability, even over a long service life, and also under high loads, in particular pressure and temperature loads.

Despite the very good and very advantageous backing-up capacity of the turbine, in particular due to the adjustability of the outlet cross section and due to its small dimensions, the turbine according to the invention has a high throughput range with a very high mass flow capacity. An appropriate efficiency characteristic is achieved even with customary displacement travel lengths actuators for adjusting the outlet cross section. Thus, the turbine according to the invention, which is also referred to as a tongue diverter turbine since the blocking member may have a tongue-shaped design, may have a throughput range quotient of greater than 3, greater than 4 or, in particular for spark ignition engines, greater than 5 with the simplest geometric specifications. The throughput range quotient is given by the quotient $$\frac{\phi_{max}}{\phi_{min}},$$

where $\phi_{max}$ refers to the maximum possible throughput of the turbine and $\phi_{min}$ refers to the minimum throughput, the turbine according to the invention being adjustable between the maximum throughput $\phi_{max}$ and the minimum throughput $\phi_{min}$ due to the adjustability of the outlet cross section and of the flow cross section. This means that the turbine according to the invention may be efficiently operated in a particularly large operating range, especially in connection with spark ignition engines, in which particularly high mass flows of the exhaust gas are present.

In addition, the achievable throughput range and the efficiency characteristic of the turbine according to the invention are also influenced in particular by the configuration and specification of the main dimensions of walls, which are fixed to the housing part and which adjoin the spiral channel at least in parts, and in relation to which the blocking member is movable for adjusting the outlet cross section. In addition, the configuration and the specification of the blocking member, which is situated, for example, in the flow direction of the exhaust gas with respect to the turbine wheel, downstream from the adjusting part, play an important role for the achievable throughput range and the efficiency characteristic of the turbine.

Combining the adjustability of the flow cross section of the bypass duct with the adjustability of the outlet cross section due to the movement of the adjusting part and also of the blocking member has the advantage that just one control element, in particular an actuator, can be used for moving the adjusting part and thus the blocking member, which is accompanied by the adjustment of the outlet cross section, and for adjusting the flow cross section of the bypass duct. This keeps the number of parts, the weight, and the installation space requirements of the turbine according to the invention low. The level of complexity of the control and regulation system for the turbine according to the invention may also thus be kept low.

In one advantageous embodiment of the invention, the adjusting part has at least one passage opening which is movable by moving the adjusting part (which is accompanied by a movement of the blocking member) in at least partial overlap with the bypass duct. If the passage opening in the adjusting part overlaps with the bypass duct or an outlet opening in the bypass duct, the exhaust gas may flow through the bypass duct while bypassing the turbine wheel, and the turbine has a very high mass flow capacity. The passage opening may have a cross section which is at least essentially equal to or greater than a flow cross section of the bypass duct or the outlet opening thereof, so that the passage opening in the adjusting part does not throttle the flow of the exhaust gas through the bypass duct when there is complete overlap with the bypass duct or the outlet opening thereof. This embodiment has the advantage that the adjustability of the flow cross section of the bypass duct is integrated into the adjusting part and is thus achieved in a particularly simple manner, which keeps the installation space requirements and the costs of the turbine low.

It is also thus possible to support the adjusting part particularly well on or in the housing part, thus at least essentially always ensuring easy movement of the adjusting part. This benefits the functional reliability of the turbine according to the invention.

In another advantageous embodiment of the invention, the adjusting part is at least partly, in particular predominantly, in particular completely, accommodated in the housing part that is a turbine housing, for example. The turbine thus has particularly low installation space requirements.

In another particularly advantageous embodiment of the invention, the bypass duct on the one hand is in fluid connection with the spiral channel and/or with a further spiral channel via which exhaust gas is suppliable to the at least one spiral channel, and on the other hand the bypass duct opens into a turbine outlet area of the housing part, downstream from the turbine wheel. In this manner the exhaust gas may be withdrawn particularly well upstream of the turbine wheel and introduced into an exhaust tract downstream from the turbine wheel without the exhaust gas being able to act on and drive the turbine wheel. This also allows bypassing of the turbine wheel without a complicated installation space.

The turbine according to the invention has particularly low installation space requirements, while at the same time achieving the described advantages, if in one advantageous embodiment of the invention the bypass duct is integrated at least partly, in particular predominantly or completely, into the housing part and/or into a further housing part of the turbine. The bypass duct may be provided, for example, by a borehole, a milled-out area, or a recess during production of the housing part by casting. As a result, additional cost- and weight-intensive line parts are not provided, and are not necessary for achieving the very high mass flow capacity and the high throughput range of the turbine according to the invention.

In another advantageous embodiment of the invention, the adjusting part is designed essentially as an adjusting ring. The adjusting part thus has a very low level of complexity and therefore low manufacturing costs, resulting in low costs for the overall turbine.

If the adjusting part for moving the blocking member is movable, in particular about a rotational axis, in the peripheral direction of the accommodation space, the movement of the blocking member and the adjustability of the outlet cross section are made possible in a particularly simple manner. For such a simple movement, there is in particular little risk of the adjusting part jamming, or of undesirably high friction or some other malfunction occurring, which benefits the very good functional reliability of the turbine.

To avoid an undesirable release of exhaust gas from the housing part to the environment, for example, at least one sealing element is advantageously situated between the adjusting part and the housing part and/or between the adjusting part and a further housing part of the turbine. Thus, at least essentially all of the exhaust gas flowing through the turbine may be guided through the turbine outlet and led to an exhaust gas aftertreatment device, situated downstream from the turbine in an exhaust tract of the internal combustion engine, which cleans the exhaust gas before it is ultimately released to the environment.

Further advantages, features, and particulars of the invention will become more readily apparent from the following description of preferred exemplary embodiments with reference to the accompanying drawings. The features and feature combinations mentioned above in the description, as well as the features and feature combinations mentioned below in the description of the figures and/or shown in the figures alone, are usable not only in the particular stated combination, but also in other combinations or alone without departing from the scope of the invention.

DESCRIPTION OF PARTICULAR EMBODIMENTS OF THE INVENTION

Figure 1:
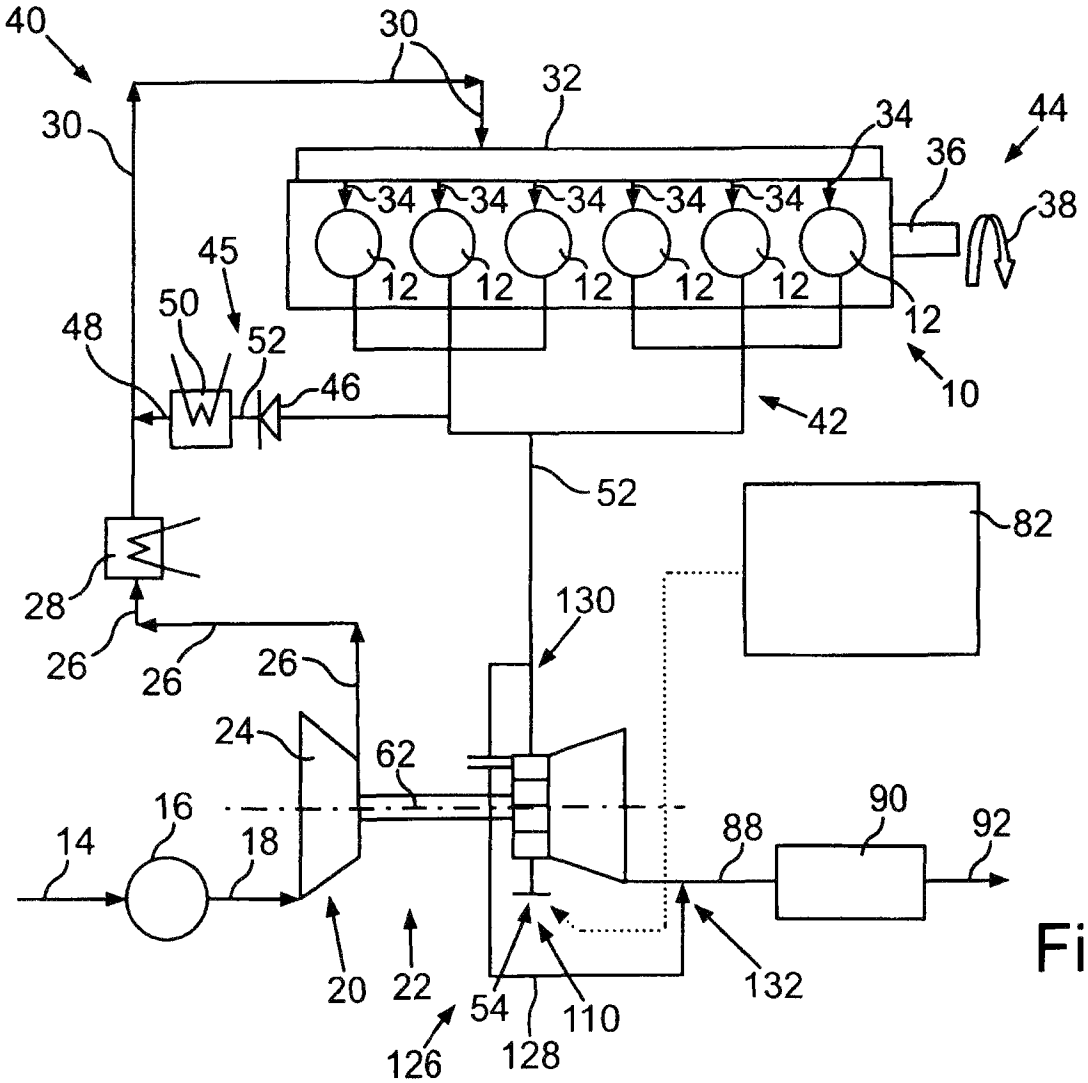
FIG. 1 shows a diagram of an internal combustion engine which is supercharged by means of an exhaust gas turbocharger, which includes a tongue diverter multi-segment turbine having a bypass duct via which a turbine wheel of the tongue diverter multi-segment turbine may be bypassed.

FIG. 1 shows an internal combustion engine 10 which has six cylinders 12. During operation of the internal combustion engine 10, the internal combustion engine draws in air according to a directional arrow 14. The air is filtered by an air filter 16 and flows further according to a directional arrow 18 into a compressor 20 of a turbocharger 22 associated with the internal combustion engine 10. The air is compressed by the compressor 20 by means of a compressor wheel 24, whereby the air is also heated. For cooling the air that is compressed and heated in this way, the air flows further according to directional arrows 26 to a charge air cooler 28, and further according to directional arrows 30 to an inlet manifold 32, via which it is supplied to the cylinders 12 according to directional arrows 34. The drawn-in and compressed air is acted on by fuel and combusted in the cylinders 12, resulting in rotation of a crankshaft 36 of the internal combustion engine 10 according to a directional arrow 38.

The compressor 20 situated on an air side 40 of the internal combustion engine 10 is used to provide a desired air supply to the internal combustion engine 10 for providing a desired level of power or torque of the internal combustion engine 10.

The internal combustion engine 10 may thus be designed with a small displacement and small dimensions, which is accompanied by low weight, high specific power, low fuel consumption, and therefore low $CO_2$ emissions.

Exhaust gas from the internal combustion engine 10 resulting from combustion in the cylinders 12 is initially directed, via exhaust gas piping 42 on an exhaust gas side 44 of the internal combustion engine, to an exhaust gas recirculation device 45, by means of which exhaust gas from the internal combustion engine 10 is recirculated from the exhaust gas side 44 to the air side 40. For this purpose, the exhaust gas recirculation device 45 includes an exhaust gas recirculation valve 46, by means of which a specified quantity of exhaust gas to be recirculated is adjustable, which is coordinated with a current operating point of the internal combustion engine 10. The exhaust gas flows to an exhaust gas recirculation cooler 50 according to a directional arrow 52, by means of which the exhaust gas is cooled before it is supplied to the air drawn in by the internal combustion engine 10 according to a directional arrow 48. This action on the drawn-in air by the recirculated exhaust gas results in less emissions, in particular nitrogen oxides and particulate emissions, from the internal combustion engine 10, which thus has not only low fuel consumption and high power, but also low emissions.

Figure 5:
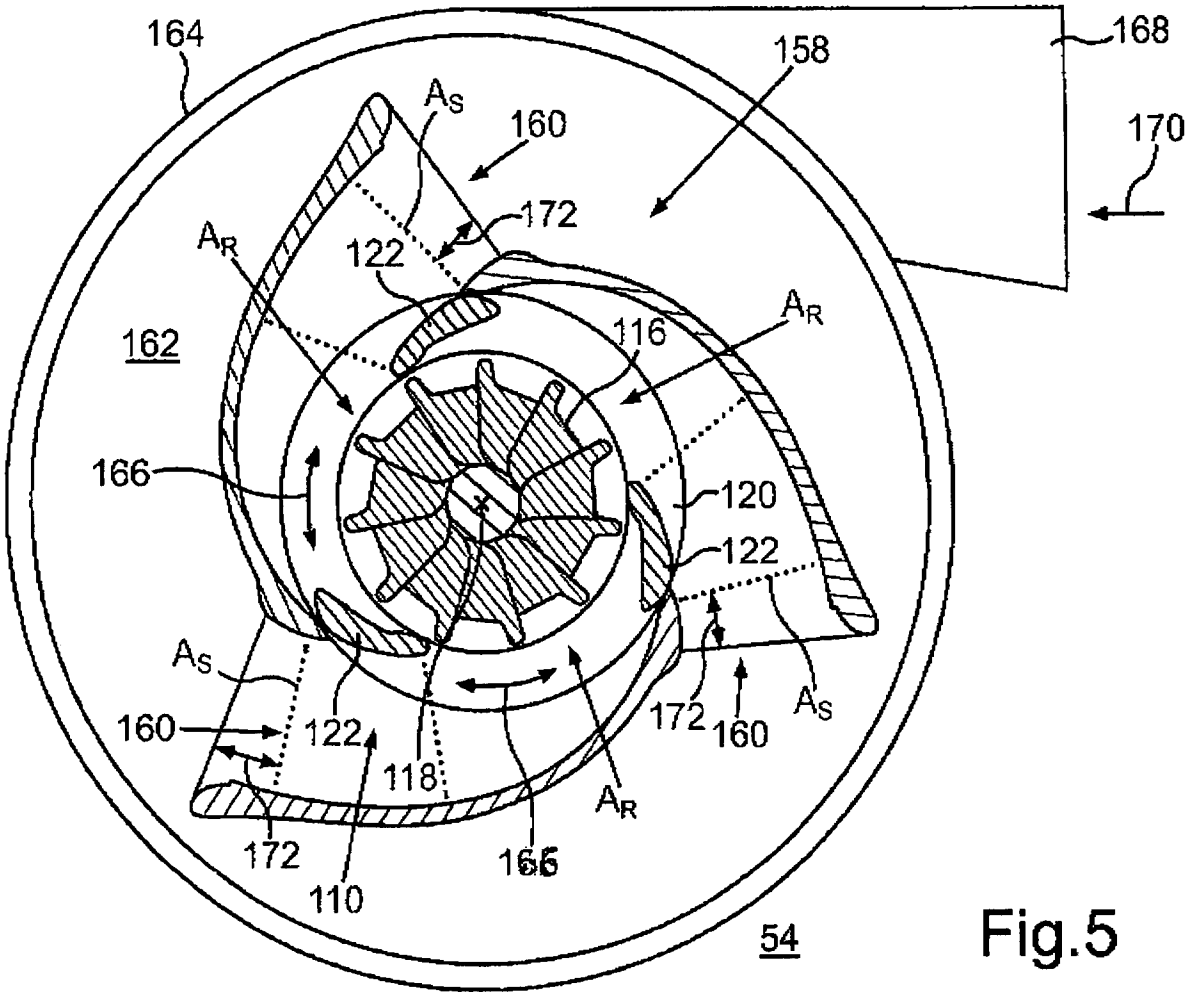
FIG. 5 shows a schematic cross-sectional view of another embodiment of the tongue diverter multi-segment turbine according to FIG. 2.

The exhaust gas of the internal combustion engine is supplied via the exhaust gas piping 42 to a turbine 54 of the exhaust gas turbocharger 22, which is explained below in conjunction with FIG. 2. It is also possible to use the turbine 54 illustrated in FIG. 5 as the turbine 54 of the exhaust gas turbocharger 22. The turbine 54 according to FIG. 5 is likewise explained below. The exhaust gas of the internal combustion engine 10 is led in part to a first spiral channel 94 designed as a partial spiral, and in part to a second spiral channel 96, likewise designed as a partial spiral. The two determining spiral channels 94 and 96 include adjacently situated connecting flanges 98 and 100 which are sealed in a gas-tight manner with respect to one another. The connecting flange 100 and a supply channel 102 of the spiral channel 96 extend below the spiral channel 94, essentially in the viewing direction relative to the plane of the drawing, the end of the supply channel 102 being shown, in the plane of the drawing, in front of a spiral inlet cross section $A_{S0,RGR}$ and a housing tongue 106 which is fixed relative to a turbine housing 104 of the turbine 54.

Figure 2:
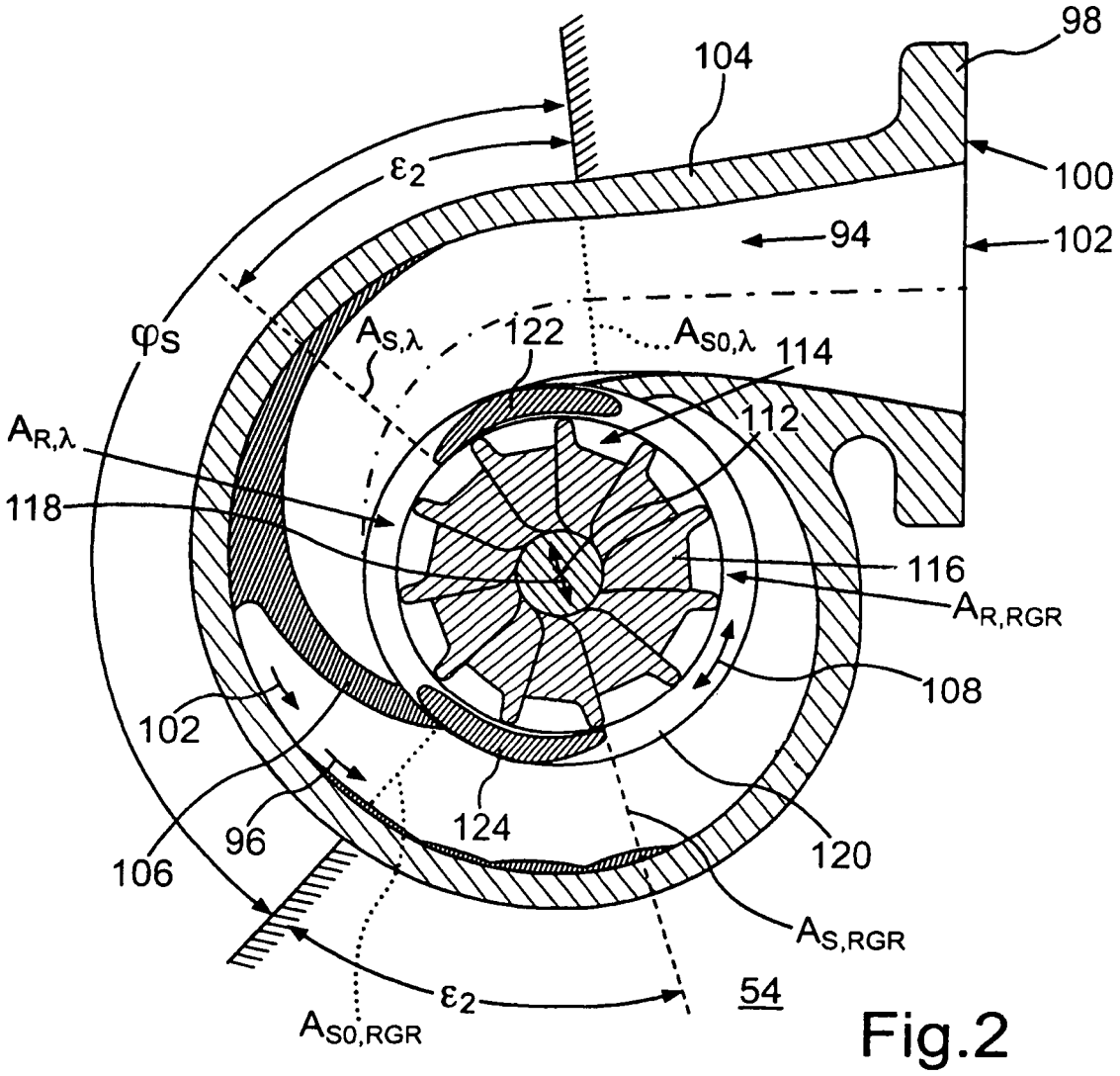
FIG. 2 shows a schematic cross-sectional view of the tongue diverter multi-segment turbine according to FIG. 1.

As is apparent from FIG. 2, the spiral channels 94 and 96 are situated one behind the other, i.e., connected one behind the other, in the peripheral direction of the turbine wheel, over the periphery thereof, according to a directional arrow 108. The first spiral channel 94 has an angle of wrap $\phi$ of approximately 135°, and functions as a so-called EGR spiral that is used to back up the exhaust gas, so that a particularly large quantity of exhaust gas is to be recirculated by means of the exhaust gas recirculation device. The second spiral channel 96, designed as a so-called $\lambda$ spiral provides by means of its backing-up capacity for a necessary air-fuel ratio of the internal combustion engine 10.

To be able to adapt the turbine 54 to a plurality of different operating points of the internal combustion engine, at least essentially over the entire performance graph of the internal combustion engine 10, in an efficiency-optimized manner, the turbine 54 includes an adjusting device 110 by means of which spiral inlet cross sections $A_{S,\lambda}$, $A_{S,RGR}$ of the spiral channels 94 and 96 are adjustable together with nozzle cross sections $A_{R,\lambda}$, $A_{R,RGR}$ of the spiral channels 94 and 96, respectively, which are open in the radial direction according to a directional arrow 112 and which are used for an inflow process to an accommodation space 114 inside of which a turbine wheel 116 is accommodated so as to be rotatable about a rotational axis 118. The adjusting device 110 is controlled or regulated by a regulating device 82.

The adjusting device 110 has an adjusting ring 120, which is situated concentrically with respect to the rotational axis 118 of the turbine wheel 116 in the turbine housing 104, and to which two blocking members 122 and 124 are connected in the area of the nozzle cross sections $A_{R,\lambda}$ and $A_{R,RGR}$, respectively. The blocking members 122 and 124 have an at least essentially tongue-shaped design, and therefore are also referred to as tongues, while the adjusting ring 120 is referred to as a tongue slider. The blocking members 122 and 124, which in the present case have an airfoil-shaped cross section, may be moved by rotational motion of the adjusting ring 120 according to the directional arrow 108, and thus in the peripheral direction of the turbine wheel 116 over its periphery, about the rotational axis 118 between a position which reduces the spiral inlet cross sections $A_{S,\lambda}$ and $A_{S,RGR}$ as well as the nozzle cross sections $A_{R,\lambda}$ and $A_{R,RGR}$, and a position which enlarges the spiral inlet cross sections $A_{S,\lambda}$ and $A_{S,RGR}$ as well as the nozzle cross sections $A_{R,\lambda}$ and $A_{R,RGR}$. In the illustration in FIG. 2, the blocking members 122 and 124 are skewed from a starting position by an angle $\epsilon_2$, so that the spiral inlet cross sections $A_{S,\lambda}$ and $A_{S,RGR}$ and the nozzle cross sections $A_{R,\lambda}$ and $A_{R,RGR}$ are set at a minimum value in each case. FIG. 2 also illustrates the maximum spiral inlet cross sections $A_{S0,\lambda}$ and $A_{S0,RGR}$ in the starting position of the blocking members 122 and 124, respectively.

Thus, with the aid of the adjusting device 110, both sides of the turbine, the EGR side and the $\lambda$ side, are simultaneously regulated or controlled with respect to one another, corresponding to the geometric configuration of the spiral channels 94 and 96 and the blocking members 122 and 124. A variety of combinations may be provided as a result of the different geometric configuration of the spiral curves over the entire adjustment angle range $\epsilon$ of the blocking members 122 and 124. The sought EGR capability of the turbine 54 together with the sought air mass flow of the compressor 20 for a suitable air-fuel ratio $\lambda$ for producing a desired operating characteristic of the internal combustion engine 10 with regard to fuel consumption and nitrogen oxides and particulate emissions may thus be set within the adjustment angle range $\epsilon$ by means of a simple and inexpensive design. The adjustment angle range $\epsilon$ in conjunction with the change in the characteristic spiral inlet cross sections $A_{S,\lambda}$ and $A_{S,RGR}$ allows the effect on the back-up behavior of the exhaust gas of the internal combustion engine 10 and on the swirl generation of the turbine 54. Thus, since the specific turbine power au is proportional to the peripheral component c1u according to the general formula $$au \sim c1u \sim 1/A_S,$$

the specific and absolute turbine power may be regulated by influencing the surface area of the spiral inlet cross sections $A_{S,\lambda}$ and $A_{S,RGR}$. The turbine 54 is usable in internal combustion engines for utility vehicles and for passenger vehicles, as well as in internal combustion engines designed as diesel engines, spark ignition engines, or combined combustion engines, such as the internal combustion engine 10.

As is apparent in particular from FIG. 1, the turbine 54 also includes a bypass device 126 having at least one bypass duct 128. The turbine wheel 116 is to be bypassed by at least a portion of the exhaust gas via the bypass duct 128, so that the exhaust gas does not act on or drive the turbine wheel 116. For this purpose, the bypass device 126 includes a branch point 130 which is situated in the flow direction of the exhaust gas, upstream from the turbine wheel 116. The bypass device 126 also includes an inlet point 132 at which the exhaust gas bypassing the turbine wheel 116 is reintroduced into the exhaust gas piping 42. The inlet point 132 is situated in the flow direction of the exhaust gas, upstream of the exhaust gas aftertreatment device 90, so that the exhaust gas bypassing the turbine wheel 116 is cleaned by the exhaust gas aftertreatment device 90 before it is released to the environment according to a directional arrow 92.

The quantity of the exhaust gas bypassing the turbine wheel 116 via the bypass duct 128 is now adjustable by means of the adjusting ring 120. The rotation of the adjusting ring 120 about the rotational axis 118 according to the directional arrow 108 not only causes a movement, in particular a displacement, of the blocking members 122 and 124 about the rotational axis 118 according to the directional arrow 108, but also brings about the adjustment of a flow cross section $A_U$ (FIG. 4) of the bypass duct 128 through which exhaust gas which bypasses the turbine wheel 116 may flow.

It may be provided that at a wall of the adjusting ring 120 in a subarea of the adjustment angle range $\epsilon$, the adjusting ring 120 reduces the flow cross section $A_U$ of the bypass duct 128 at least essentially to zero, and thus at least essentially fluidly blocks the flow cross section, so that exhaust gas is not able to flow through the bypass duct 128. As the result of moving the adjusting ring 120 in the adjustment angle range $\epsilon$ in one direction, beginning at a certain position of the adjusting ring 120 the adjusting ring 120 opens up the flow cross section $A_U$ of the bypass duct 128 at least in parts, so that exhaust gas is able to flow through the bypass duct 128. If the adjusting ring 120 is moved further in this direction, the flow cross section of the bypass duct 128 is successively enlarged and further opened up, accompanied by a successively larger quantity of exhaust gas that is able to flow through the bypass duct 128 in order to bypass the turbine wheel 116.

It may be provided that the adjusting ring 120 is moved in this direction in the adjustment angle range $\epsilon$ until the adjusting ring is rotated or moved into an end position of the adjustment angle range in which the flow cross section $A_U$ of the bypass duct 128 is opened up to a maximum. Likewise, it may be provided that at the maximum adjustment of the flow cross section $A_U$, and thus at a maximum opening up of the bypass duct 128, the adjusting ring 120 is in a position from which it may be further moved in the same direction in which it has previously been moved in order to successively enlarge the flow cross section $A_U$. If this is the case, the flow cross section $A_U$ may, for example, then be held constant at its maximum adjustable value. It is likewise possible that by further movement, in particular rotation, of the adjusting ring 120 the flow cross section $A_U$ is once again successively reduced until the adjusting ring 120 has reached its end position in the adjustment angle range $\epsilon$. In this end position, the flow cross section $A_U$ may then optionally once again be reduced at least essentially to zero.

It is thus possible to adjust the flow cross section $A_U$ of the bypass duct 128 in a variety of ways, and thus to adapt the turbine 54, in particular its mass flow capacity, to a plurality of different operating points of the internal combustion engine 10.

As a result of opening up the bypass duct 128, particularly high mass flows of the exhaust gas of the internal combustion engine 10 may flow through the turbine 54, in that a portion of the mass flow passes through the turbine wheel 116 and flows through the turbine 54, and a portion of the exhaust gas flow passes through the turbine 54 via the bypass duct 128. In other words, providing a very high mass flow capacity of the turbine 54, and thus providing a very high throughput range, is made possible by opening up the bypass duct 128. At the same time, blocking the bypass duct 128 allows provision of a very good backing-up capacity of the turbine 54 in order to be able to recirculate a particularly large quantity of exhaust gas.

In addition, the turbine 54 has very good adaptability to a plurality of different operating points, in particular at least essentially over the entire characteristic map of the internal combustion engine 10, since diverse adjustability of the turbine 54 is provided by the blocking members 122 and 124. The internal combustion engine 10 may thus be operated very efficiently, and in particular with low fuel consumption and low emissions, which also results in low $CO_2$ emissions.

Figure 3:
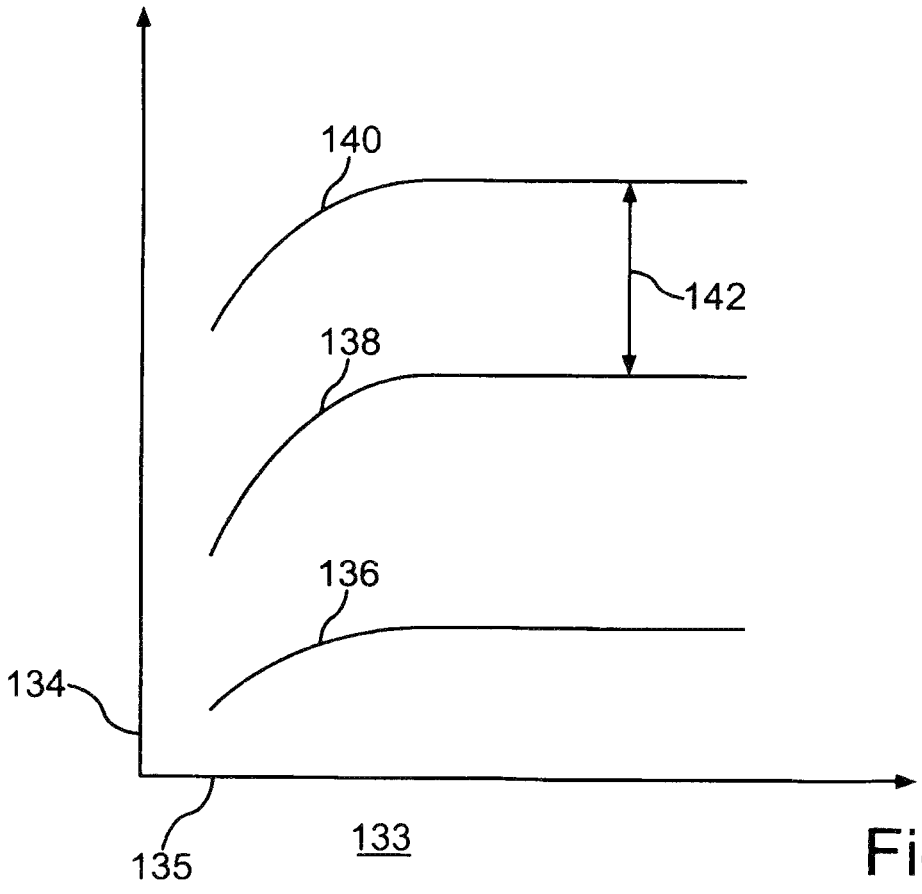
FIG. 3 shows three different curves of the throughput parameter of the tongue diverter multi-segment turbine according to the preceding figures.

FIG. 3 shows a turbine throughput characteristic map 133 of the turbine 54, with the turbine pressure ratio $\pi_{ts}$ plotted on the abscissa 135 and the throughput parameter $\phi_T$ plotted on the ordinate 134. The turbine throughput characteristic map 133 may be applied to the turbine 54 according to FIG. 5. A curve 136 of the throughput parameter $\phi_T$ is plotted in the turbine throughput characteristic map 133, which results when the blocking members 122 and 124 are set in a minimum position in the adjustment angle range $\epsilon$, in which the nozzle cross sections $A_{R,\lambda}$ and $A_{R,RGR}$ and/or the spiral inlet cross sections $A_{S,\lambda}$ and $A_{S,RGR}$ are set to a minimum value in each case.

Another curve 138 of the throughput parameter $\phi_T$ is also illustrated, which results when the blocking members 122 and 124 are set by means of the adjusting ring 120 in a maximum position in which the nozzle cross sections $A_{R,\lambda}$ and $A_{R,RGR}$ and/or the spiral inlet cross sections $A_{S,\lambda}$ $A_{S,RGR}$ are set to a maximum value in each case.

A curve 140 of the throughput parameter $\phi_T$, illustrated in FIG. 3, results when, in addition to the maximum position, the bypass duct 128 is in particular opened up to the maximum by means of the adjusting ring 120. This means that in the turbine throughput characteristic map 133, the bypass duct 128 is essentially fluidly blocked between the curve 136 and the curve 138, and in the curves 136 and 138. If the bypass duct is successively opened up by means of the adjusting ring 120, starting from the maximum blocking position of the blocking members 122 and 124, the throughput parameter 4 of the turbine 54 is shifted, for example for an at least essentially constant turbine pressure ratio $\pi T_{ts}$, along the ordinate 134 to higher values in the direction of the curve 140, starting from the curve 138. If the flow cross section $A_U$ of the bypass duct 128 is reduced, starting from the maximum flow cross section $A_U$, and the blocking members 122 and 124 are in the maximum position, the throughput parameter $\phi_T$ is shifted, for at least essentially constant turbine pressure ratio $\pi_{ts}$, from the curve 140 in the direction of the curve 138.

This influencing of the throughput parameter $\phi_T$ by enlarging or reducing the flow cross section $A_U$ of the bypass duct 128 while the blocking members 122 and 124 are in the maximum position is indicated by a directional arrow 142 in FIG. 3. An area along the ordinate 134 between the curve 138 (blocking members 122 and 124 in the maximum position, bypass duct 128 fluidly blocked) and the curve 140 (blocking members 122 and 124 in the maximum position, bypass duct 128 opened up to the maximum) is thus referred to as a blow-off area, in which the throughput parameter $\phi_T$ assumes very high values and may be variably adjusted as a result of increasing or reducing the flow cross section of the bypass duct 128. The bypassing of the turbine wheel 116 via the bypass duct 128 is referred to as "blow-off."

Figure 4:
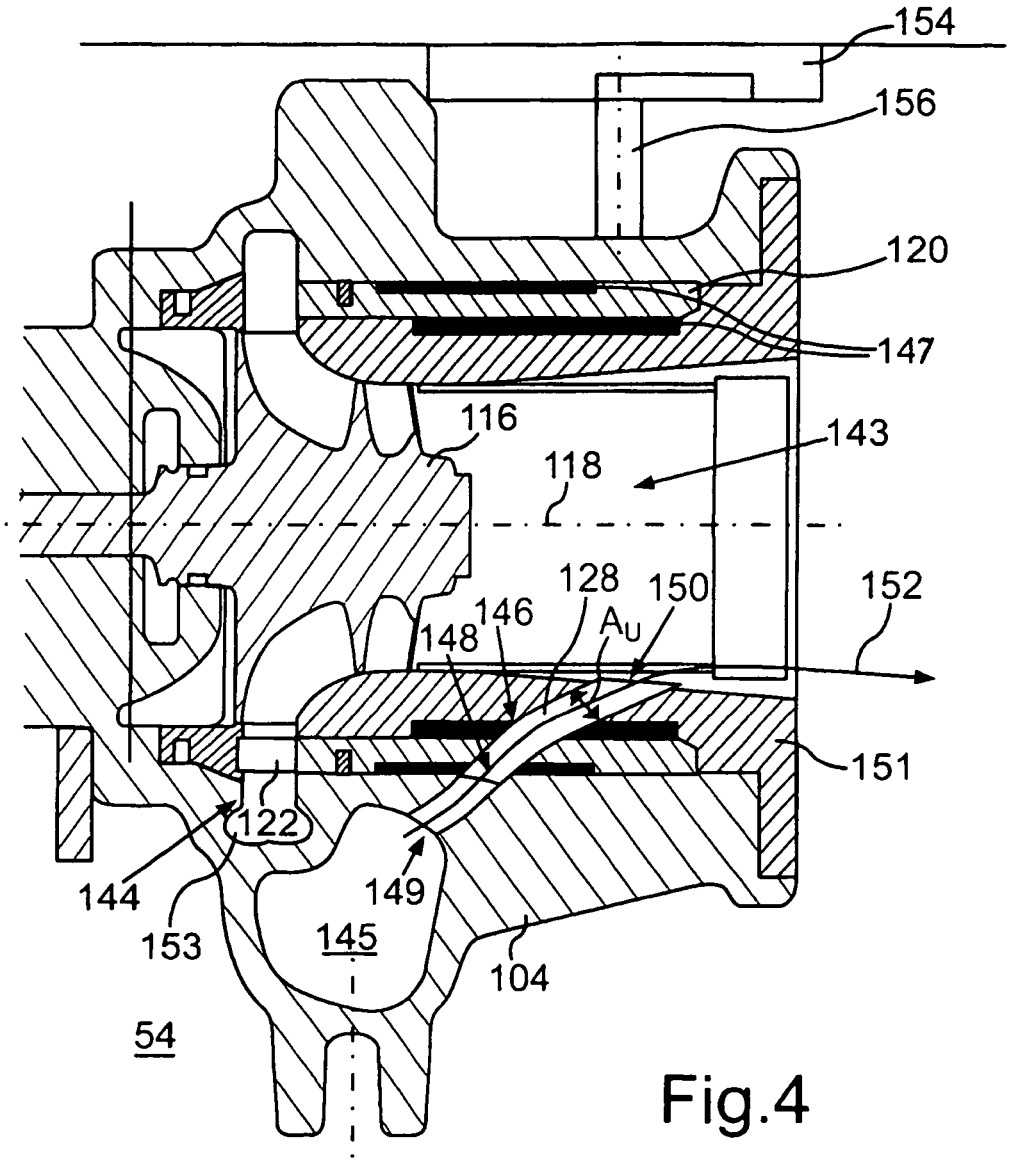
FIG. 4 shows a section of a schematic longitudinal view of another embodiment of the tongue diverter multi-segment turbine according to the preceding figures.

FIG. 4 shows another embodiment of the turbine 54 together with the turbine housing 104. The turbine housing 104 has a spiral channel 145, designed as a supply channel, and at least one further spiral channel 153. The spiral channel 145 is in fluid connection with the spiral channel 153, so that the exhaust gas initially flows through the spiral channel 145, and from there flows into the spiral channel 153. For example, the turbine housing 104 forms, at least in parts, at least one further spiral channel (not illustrated in FIG. 4), such as the spiral channel 153, so that the spiral channel 145 is fluidly divided by the spiral channel 153 and the at least one further spiral channel. The spiral channel 145 then also functions as a collecting channel in which the exhaust gas may collect, and by means of which a back-up charging operation of the internal combustion engine 10 may be provided. It is noted at this point that a back-up charging operation of the internal combustion engine 10 may also be advantageously provided by means of the turbine 54 according to FIG. 2.

As is apparent from FIG. 4, the bypass duct 128 has an inlet opening 149 via which the bypass duct is in fluid connection with the spiral channel 145. The bypass duct 128 also has an outlet opening 150 via which the bypass duct opens into a turbine wheel outlet 143. The exhaust gas may thus be branched off from the spiral channel 145 upstream of the turbine wheel 116, and led to the turbine wheel outlet 143 while bypassing the turbine wheel 116. Thus, the exhaust gas flowing through the bypass duct 128 does not flow through the turbine wheel 116 via a ring nozzle 144. It is also possible for the bypass duct 128 to be in fluid communication with the spiral channel 153 in order to thus branch off the exhaust gas upstream of the ring nozzle 144.

As is apparent from FIG. 4, the adjusting ring 120 has at least one passage opening 146 which is delimited by walls of the adjusting ring 120. Corresponding to the desired turbine throughput performance graph, such as the throughput characteristic map 133 according to FIG. 3, for example, beginning at a certain position of the adjusting ring 120 in the adjustment angle range $\epsilon$ an overlap results between the passage opening 146 in the adjusting ring 120 and the bypass duct 128 or an outlet opening 148 in the bypass duct 128, via which the exhaust gas may exit from the bypass duct 128 in the turbine housing 104 and flow through the passage opening 146 in the adjusting ring 120. A maximum blow-off cross section for a maximum throughput capability of the turbine 54 is provided when the passage opening 146 completely overlaps with the bypass duct 128. A partial flow of the exhaust gas may thus be branched off from the spiral channel 145, and in the present case, led over an applicable outer contour piece 151 of the turbine 54 into the turbine wheel outlet 143 according to a directional arrow 152 while bypassing the turbine wheel 116.

As is further apparent from FIG. 4, the bypass duct 128 is formed partly in the turbine housing 104 and partly in the outer contour piece 151, these partial areas being in fluid connection with one another via the passage opening 145 of the adjusting ring 120 when the passage opening 146 of the adjusting ring 120 at least partially overlaps with the corresponding partial areas of the bypass duct 128.

FIG. 4 also illustrates sealing elements and/or compensators 147, by means of which the adjusting ring 120 and/or the outer contour piece 151 is/are sealed off, so that exhaust gas is not able to undesirably flow out from the turbine housing 104 to the environment. It is particularly apparent from FIG. 4 that the locking member 122, and thus also the blocking member 124, are connected to the adjusting ring 120, for example designed as one piece, and are movable together with the adjusting ring 120.

FIG. 4 schematically illustrates an actuator 154 which is connected to the adjusting ring 120 via an actuating part 156, by means of which the adjusting ring 120 and thus the blocking members 122 and 124 are variably adjustable. Since the adjustment or movement of the adjusting ring 120, and thus of the blocking members 122 and 124, is accompanied by the movement of the passage opening 146 relative to the bypass duct 128 or the partial areas thereof, only the actuator 154 is necessary as the sole actuator in order to adjust the spiral inlet cross sections $A_{S,\lambda}$ and $A_{S,RGR}$ and/or the nozzle cross sections $A_{R,\lambda}$, $A_{R,RGR}$, as well as the quantity of the exhaust gas which bypasses the turbine wheel 116 and flows through the bypass duct 128.

The turbine 54 according to FIG. 5 is designed as a single-flow, so-called tongue diverter multi-segment turbine. The turbine includes a first housing part 158 which has three spiral channels 160 through which exhaust gas of the internal combustion engine 10 may flow. The spiral channels 160 each have spiral inlet cross sections $A_S$ and nozzle cross sections $A_R$. A turbine wheel 116 of the turbine 54 which is rotatable about a rotational axis 118 is accommodated in the housing part 158.

The exhaust gas of the internal combustion engine 10 now enters into the spiral channels 160 via the respective spiral inlet cross sections $A_S$ and reaches the turbine wheel 116 via the respective nozzle cross sections $A_R$, causing the turbine wheel 116 to be driven and rotated by the exhaust gas. The turbine wheel 116 is connected to a shaft of the exhaust gas turbocharger 22, to which the compressor wheel 24 is also connected in a rotationally fixed manner, as the result of which the compressor wheel 24 is driven by the turbine wheel 116 via the shaft.

The turbine 54 also includes an adjusting device 110, which in turn includes an adjusting ring 120 which is connected to three blocking members 122 in the form of tongue diverters, each tongue diverter being associated with one of the spiral channels 160. The adjusting ring 120 is rotatable about the rotational axis 118 of the turbine wheel 116 in the direction of directional arrows 166, as the result of which the spiral inlet cross sections $A_S$ as well as the nozzle cross sections $A_R$, uniformly distributed in the peripheral direction of the turbine wheel 116 over the periphery thereof, are adjustable. In other words, the tongue diverters are adjustable between at least one position which narrows or even closes the nozzle cross sections $A_R$, and at least one position which opens up with respect to the nozzle cross sections $A_R$, by rotation of the adjusting ring 120. Variability of the turbine 54 is provided by the adjusting device 110, as the result of which the turbine 54 is adaptable to different operating points, at least essentially over the entire characteristic map of the internal combustion engine 10, to provide operation of the internal combustion engine which is efficient and thus low in fuel consumption and low in emissions. The back-up behavior and the throughput behavior of the turbine 54 may be variably set by adjusting the nozzle cross sections $A_R$.

A pulse charging operation of the internal combustion engine 10 is initially possible due to the spiral channels 160 which form multiple segments of the turbine 54. To allow a back-up charging operation of the internal combustion engine 10, the turbine 54 now includes a collection housing 164 by means of which a shared collecting space 162 that is sealed off in a gas-tight manner with respect to the environment by the collection housing 164 and the spiral channels 160 are formed, in which the housing part 158 is accommodated, whereby the collection housing 164 may surround the housing part 158 on the side of a bearing device, and thus on a side facing the compressor wheel 24 and/or on an opposite side, i.e., on the side of a turbine outlet. The collection housing 164 has an inlet channel 168 in which exhaust gas may flow in via the exhaust gas piping 42 according to a directional arrow 170, and which leads the exhaust gas further into the collecting space 162. As is apparent from FIG. 5, the inlet channel 168 tapers in the flow direction of the exhaust gas according to the directional arrow 170. The exhaust gas introduced into the collecting space 162 via the inlet channel 168 is initially collected in the collecting space 162, and may flow through the spiral channels 160 to the turbine wheel 116. The exhaust gas is mixed and collected in the flow direction of the exhaust gas through the exhaust gas piping 42 upstream from the housing part 158.

Upstream of each of the spiral inlet cross sections $A_S$, the spiral channels 160 in each case have an at least essentially trumpet-shaped inlet channel area 172 via which the exhaust gas may enter into the spiral channels 160. The turbine 54 has a high level of variability, as the result of which different back-up behaviors, and thus different EGR rates, may be provided. Likewise, this allows provision of a certain air supply to the internal combustion engine 10 to meet high power and torque requirements. In addition, the turbine 54 has only a small number of parts, accompanied by low costs and a high level of operational reliability.

In principle, it is also possible to provide double-flow turbines analogously to the embodiment of the turbine 54 according to FIG. 5, in which case a further housing part having at least two spiral channels, for example in the form of the housing part 158, is situated along the rotational axis 118 of the turbine wheel 116 next to the housing part 158, and is accommodated in a further accommodation space formed by a further housing part according to the collection housing 164, according to the accommodation space 166. Thus, the collecting spaces are then situated in parallel and separated from one another in a gas-tight manner. In this case two housing parts 158 connected in parallel are provided, each of which has a certain back-up effect and brings about a certain pulse charging of the two collecting spaces, which are gas-tight with respect to one another, when the cylinder groups of the cylinders 12 of the internal combustion engine 10 are separated, for example by means of an elbow part, so that, with an adjusting device according to the adjusting device 110 on both sides and a corresponding tongue diverter, a variable, quasi-double-flow pulse turbine is provided which may also involve asymmetrical back-up behavior, depending on the application.

The adjusting device 110 of the turbine 54 is controlled or regulated by the regulating device 82 of the internal combustion engine 10, which adjusts the adjusting device in order to adapt the turbine 54 to an operating point of the internal combustion engine 10 present at that moment.

The turbine 54 according to FIG. 5 also includes the above-described bypass device 126 having at least one bypass duct 128, the quantity of the exhaust gas bypassing the turbine wheel 116 via the bypass duct 128 being adjustable by means of the adjusting ring 120. The rotation of the adjusting ring 120 about the rotational axis 118 according to the directional arrows 162, similarly to that previously described, not only causes movement, in particular displacement, of the tongue diverters about the rotational axis 118, but also brings about the adjustment of the flow cross section $A_U$ (FIG. 4) of the bypass duct 128, through which the exhaust gas which bypasses the turbine wheel 116 may flow.

What is claimed is:

1. A turbine (54) for an exhaust gas turbocharger (22) of an internal combustion engine (10), comprising:

a housing part (104) having an accommodation space (114) including a turbine wheel (116) and at least one spiral channel (94, 96) for conducting exhaust gas of the internal combustion engine (10) to the turbine wheel (116), the at least one spiral channel (94, 96) having an outlet cross section ($A_R$, $A_{R,\lambda}$ $A_{R,RGR}$) for admitting exhaust gas to the turbine wheel (116) which is accommodated in the accommodation space (114) and acted on by the exhaust gas supplied via the spiral channel (94, 96), and an adjusting ring (120) rotatably supported and accommodated in the housing part (104) with at least one blocking member (122, 124) connected to the adjusting ring (120) for movement therewith in a peripheral direction (108) of the accommodation space (114) for adjusting the outlet cross section ($A_R$, $A_{R,\lambda}$ $A_{R,RGR}$) of the at least one spiral channel (94, 96) and at least one bypass channel (128) extending from the at least one spiral channel through a radial opening (148) in the adjusting ring (120) to a turbine outlet area (143) for permitting exhaust gas to bypass the turbine wheel (116), the bypass channel (128) having a flow cross section (Au) which is also adjustable by rotation of the adjusting ring (120) for controlling the exhaust gas flow bypassing the turbine wheel accommodation space (114).

2. The turbine (54) according to claim 1, wherein the bypass channel (128) has at least one flow passage (146) with a flow cross-section which is adjustable by movement of the adjusting ring (120) into an overlapping position with the by-pass channel (128).

3. The turbine (54) according to claim 1, wherein the bypass channel (128) is in fluid communication with at least one of the spiral channel (94, 96) and a further spiral channel (102) via which exhaust gas is supplied to the at least one spiral channel (94, 96), and the bypass duct opens into a turbine outlet area (143) of the housing pert (104) downstream from the turbine wheel (116).

4. The turbine (54) according to claim 1, wherein the adjusting ring (120) is movable so as to move the blocking member (122, 124) in the peripheral direction (108) of the accommodation space (114).

5. The turbine (54) according to claim 1, wherein at least one sealing element (147) is disposed between the adjusting ring (120) and at least one of an outer housing part (104) end an inner housing part (151) of the turbine (54).

6. The turbine (54) according to claim 5, wherein the bypass duct (128) is integrated at least partly into the outer and inner housing parts (104, 151) of the turbine (54).

* * * * *